United States Patent [19]

White

[11] Patent Number: 4,865,691

[45] Date of Patent: Sep. 12, 1989

[54] PROCESS FOR INTERNALLY STRENGTHENING PAPER AND BOARD PRODUCTS AND PRODUCTS RESULTING THEREFROM

[75] Inventor: Beverly M. White, West Boxford, Mass.

[73] Assignee: Colloids, Inc., Marietta, Ga.

[21] Appl. No.: 118,178

[22] Filed: Nov. 5, 1987

[51] Int. Cl.[4] ..... D21H 3/44

[52] U.S. Cl. ..... 162/168.1; 162/183

[58] Field of Search ..... 162/157.2, 168.1, 146, 162/183

[56] References Cited

U.S. PATENT DOCUMENTS

| | | | |
|---|---|---|---|
| 2,136,110 | 11/1938 | Lane et al. | 92/21 |
| 2,330,314 | 9/1943 | Schwartz | 117/140 |
| 2,402,469 | 6/1946 | Toland et al. | 162/168.1 |
| 2,563,897 | 8/1951 | Wilson et al. | 92/21 |
| 2,601,598 | 6/1952 | Daniel, Jr. et al. | 92/21 |
| 3,114,670 | 12/1963 | Iwasaki | 162/146 |
| 3,183,137 | 5/1965 | Harmon et al. | 156/309 |
| 3,257,267 | 6/1966 | Hay | 162/159 |
| 3,276,359 | 10/1966 | Worthen et al. | 101/149.2 |
| 3,644,912 | 5/1972 | Olson | 161/161 |
| 3,773,513 | 11/1973 | MacClaren | 96/85 |
| 3,878,038 | 4/1975 | Opderbeck et al. | 162/167 |
| 3,937,865 | 2/1976 | Jongetjes | 162/168.1 |
| 4,042,748 | 8/1977 | Hebbel et al. | 428/323 |
| 4,170,672 | 10/1979 | Moriya et al. | 427/391 |
| 4,372,814 | 2/1983 | Johnstone et al. | 162/124 |
| 4,501,640 | 2/1985 | Soerens | 162/111 |

FOREIGN PATENT DOCUMENTS

| | | | |
|---|---|---|---|
| 41-6605 | 4/1966 | Japan | 162/146 |
| 42-12286 | 7/1967 | Japan | 162/146 |
| 12608 | 5/1968 | Japan . | |
| 55-36759 | 9/1980 | Japan | 162/146 |

OTHER PUBLICATIONS

Article from 1982 Tappi Paper Makers Conference, David W. Zunker, 1982.

Polyvinyl Alcohol (Chp. 12–"Use of Polyvinyl Alcohol in Paper Manufacture"), John Wiley & Sons (Kaname Tsunemitsu, et al.), 1973.

*Primary Examiner*—Peter Chin

*Attorney, Agent, or Firm*—Bell, Seltzer, Park & Gibson

[57] ABSTRACT

A new method for internally strengthening products formed from fibrous materials and the resulting products are provided. The method is characterized by the use of a wet-end additive and specifically a particular grade of polyvinyl alcohol which is super-hydrolyzed and which is substantially insoluble in water maintained at 130 degrees Fahrenheit. In addition, the polyvinyl alcohol particles have an extremely high hydrated bulk volume so that they form a highly stable suspension in water and which aids in achieving high retention of the particles in the web of the resulting product. The products formed by the method as described exhibit substantial improvements in strength properties.

17 Claims, 3 Drawing Sheets

PROCESS FOR INTERNALLY STRENGTHENING PAPER AND BOARD PRODUCTS AND PRODUCTS RESULTING THEREFROM

BACKGROUND OF THE INVENTION

This invention relates to a process for internally strengthening paper or board products during their manufacture and to the resulting products having enhanced properties. The papermaking industry as well as other industries have long sought methods for enhancing the strength of products formed from fibrous materials such as, for example, paper and board products formed of cellulose fiber or pulp as a constituent. The problems and limitations presented by inadequate dry strength have been particularly acute in the numerous industries where recycled or mechanically ground furnish is utilized in whole or part. In the papermaking industry for example, recycled cellulose fiber is typically used in the manufacture of newsprint and lightweight coated papers. These recycled fibers, however, are of a generally shorter length than chemically-pulped fibers which in turn provides paper having relatively poor dry-strength properties in comparison to paper manufactured from virgin, chemically pulped fiber. The use of virgin, chemically pulped fiber for all paper and board production, however, is extremely wasteful in terms of natural resource utilization as well as cost prohibitive in most instances and applications.

Various methods have been suggested in the past for improving the dry-strength and related properties of a sheet formed from fibrous materials such as paper or board materials formed of cellulose fiber. One alternative for improving the dry-strength properties of paper products, for example, involves the surface sizing of the sheet at a size press or calendar stack after its formation. While some of the critical properties of the product may be improved through sizing the surface of the sheet, most papermaking machines, for example, including board, coated publishing and newsprint machines, are not equipped with a size press. Moreover, only the properties of the surface of the sheet are appreciably improved through surface sizing. Surface sizing therefore is either not available to a large segment of the industry or is inadequate for purposes of improving the strength of the product throughout the sheet. The latter factor is especially significant since paper breaks during printing, for example, are obviously disruptive to production and extremely costly.

A preferred alternative to surface sizing of a sheet is to increase the strength of the product through the addition of chemical additives directly to the fiber furnish prior to forming the sheet. Common additives at the wet-end of a paper machine, for example, include cationic starch or melamine resins. The problem presented by known wet-end additives used in the papermaking industry, however, is their relatively low degree of retention on the cellulose fiber during the initial formation of the sheet at the wet-end of the paper machine. In most applications, significant portions of the wet-end additives accompany the white water fraction as it drains through the wire due to high dilution and the extreme hydrodynamic forces created at the slice of a fourdrinier machine, for example. Alternatively, a significant portion of the additive may be lost in solution during the dwell time between its addition to the stock and the subsequent formation of the sheet on the machine at prevailing operating temperatures. Accordingly, the potential benefits achievable through the use of known methods for internally strengthening fiber products have seldom been realized in practice. And, when the cost of the chemical additives is additionally considered, any marginal benefits actually achieved have been largely disappointing.

A previously known and particularly desirable surface sizing agent applied in the paper industry is polyvinyl alcohol. The use of polyvinyl alcohol as a surface sizing agent or adhesive is described, for example, in U.S. Pat. Nos. 2,330,314 to Schwartz; 3,183,137 to Harmon et al.; 3,276,359 to Worthen et al.; and 3,878,038 to Opderbeck et al. Other patents have additionally described the use of polyvinyl alcohol as a surface sizing agent following the use of different compositions as wet-end additives, such as melamine formaldehyde resin, as described, for example, in U.S. Pat. No. 3,773,513 to MacClaren. In addition, U.S. Pat. No. 4,372,814 to Johnstone et al., describes the use of fully hydrolyzed polyvinyl alcohol as a "binder" for a distinct group of wet-end additives and again, thereafter, as a surface sizing agent.

U.S. Pat. No. 2,402,469, Toland et al., describes the use of polyvinyl alcohol as a wet-end additive to improve the wet-strength as opposed to dry-strength properties of the sheet. The addition level proposed in the Toland patent, however, is approximately ten percent on an oven-dried weight basis of the pulp, apparently reflecting extremely low-retention at the wet-end even at the relatively low paper machine operating speeds which prevailed at that time. In addition, the polyvinyl alcohol product described in Toland et al. is soluble in water at 130 degrees Fahrenheit. Since many paper machine chests are maintained at prevailing temperatures of 130 degrees Fahrenheit, or higher, the process described in the Toland et al. patent would therefore be ineffectual in most, if not all, papermaking applications.

In a 1973 publication by John Wiley and Sons on the subject of polyvinyl alcohol, Chapter 12 is devoted to discussions of the use of this product in paper manufacturing. This chapter was authored by two employees of Nippon Gohsei Co., Ltd. of Osaka, Japan. In Section 12.4, the subject of "internally sizing" paper with polyvinyl alcohol is addressed and references the above-noted Toland, et al. patent and additionally Japanese Patent No. 12,608 relating to layered board and assigned to Nippon Gohsei. The publication describes the desirable properties of a polyvinyl alcohol product which purportedly can be used as a wet-end additive and identifies a particular grade sold by Nippon Gohsei, "Gohsenol P-250," as suitable for direct addition to beater size. The Gohsenol P-250 product is described in the publication as 98–99 mole percent hydrolyzed and as having a dissolving temperature of 67–70° C.

In a 1982 technical paper presented during the 1982 TAPPI Papermakers Conference, Dr. David Zunker of E.I. duPont de Nemours & Company, Inc. describes the significant problem in achieving any retention of polyvinyl alcohol at the wet-end of a paper machine. In that paper, the use of mixtures of polyvinyl alcohol and cationic trimethylolmelamine as a binder is proposed as a solution to the retention problem. The use of "TMM" as proposed by Dr. Zunker, or alternatively the use of cationic starch as a retention aid for polyvinyl alcohol, has not been successful, however, because the negatively-charged anionic white water quickly neutralizes the positive, cationic charges of the starch or TMM after the paper machine reaches equilibrium in its white water system. In addition, TMM is a known enhancer of wet-strength properties which presents distinct problems in repulping any fully dried broke for reuse as furnish.

In view of the foregoing, it is a primary object of the present invention to provide a method for internally strengthening products formed from fibrous materials, and especially paper and board products, by successfully incorporating polyvinyl alcohol of defined properties into the formed sheet prior to drying. It is an additional object of this invention to provide a method which results in surprisingly high retention of the polyvinyl alcohol on the pulp fiber even at relatively high operating temperatures in order to obtain the maximum benefit from the use of the additive, including enhanced strength properties at economically feasible levels of addition.

SUMMARY OF THE INVENTION

In order to achieve the foregoing objects of the invention, a method for internally strengthening paper, board, and other products using polyvinyl alcohol as an additive is provided. The invention is characterized by the successful and surprising retention of the wet-end additive particularly on pulp fiber even under extreme hydrodynamic conditions and relatively high operating temperatures such as those present at the headbox of a fourdrinier paper or board machine. In accordance with the method of the present invention, a particular grade of polyvinyl alcohol having unique properties is employed. In particular, the polyvinyl alcohol suitable for use in the present invention is a super-hydrolyzed, amorphous grade which exhibits a high degree of swelling when fully hydrated and which retains the swollen state in aqueous suspensions for extended periods of time. In addition, the additive exhibits exceptional resistance to dissolving even at temperatures in excess of 130 degrees Fahrenheit.

The particular polyvinyl alcohol useful in practicing the invention has been introduced within the past couple of years for use in surface sizing. This product is processed from material imported from China where technology long thought inadequate for economical, mass-production of polyvinyl alcohol is employed. Unlike its domestic counterparts useful only in surface sizing in accordance with conventional wisdom and the Gohsenol P-250 product described above, this grade of polyvinyl alcohol may be successfully employed as a wet-end additive even in environments where the aqueous fiber suspension is maintained at or above 120–130 degrees Fahrenheit. The fully hydrated wet-end additive has a characteristic branched appearance and a consistency much like that of cellulose fiber which aids in achieving significant levels of retention on fiber in actual use as evidenced by the greatly enhanced strength of the sheet, even when the products, which are additionally disclosed, are formed in highly turbulent environments.

BRIEF DESCRIPTION OF THE DRAWINGS

Additional features and benefits of the invention will be described belowed in connection with the accompanying drawings, in which.

DETAILED DESCRIPTION OF THE PREFERRED EMBODIMENT

Figure 1:
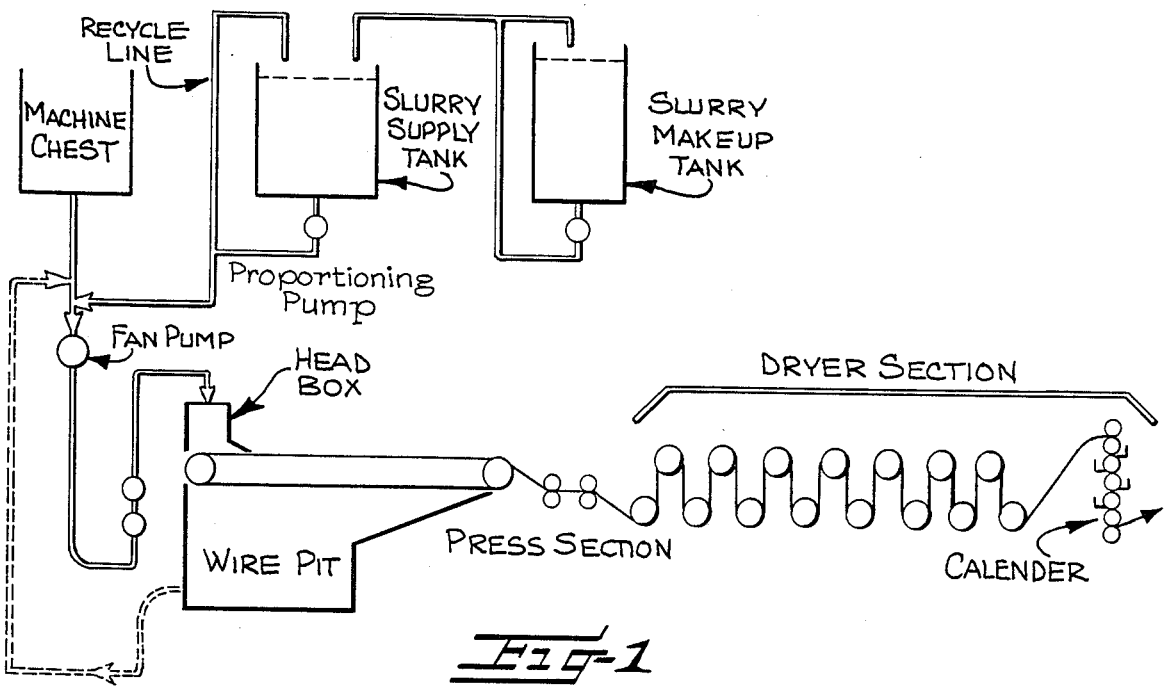
FIG. 1 is a schematic view of a typical paper machine layout including provisions for adding the wet-end additive in accordance with a preferred embodiment of the invention.

The invention described herein has widespread ramifications for the paper and board manufacturing industries in particular, but can be applied in virtually any setting where improved strength and related improvements in dimensional properties in a fiber-based product are desired. The invention holds particular significance, however, for the papermaking industry and especially for manufacturers of newsprint and lightweight printing papers since the invention provides a ready means for effectively improving the quality of the sheet in an economic fashion without resorting to costly and largely ineffective additives or to even more costly machine modifications.

The preferred wet-end additive for use in accordance with the invention is a substantially noncrystalline, super-hydrolyzed polyvinyl alcohol additive. By super-hydrolyzed, it is meant that the additive has a mole percent hydrolyzation in the range of 99.6–99.95. In addition, the additive swells extensively in water and has an extremely high "hydrated bulk volume" in the swollen state. The term "hydrated bulk volume" as used herein refers to the apparent volume as measured in milliliters which is occupied by a gram of the product when fully hydrated in water for an extended period. In this regard, the additive used in accordance with the invention has a bulk volume greater than about 10.0 mls./gm. The additive also has an extremely low dry bulk density on the magnitude of less than about 0.275 gms./ml. at a 200 mesh particle size. The additive is also extremely temperature insensitive and will not fully dissolve unless temperatures of approximately 205 degrees Fahrenheit are maintained for a sustained period.

As alluded to above, the particular polyvinyl alcohol additive useful in practicing the present method is unique in comparison to prevailing commercial grades of polyvinyl alcohol available in the marketplace. In this connection, the polyvinyl alcohol wet-end additive of the present invention is formed from larger polyvinyl alcohol particles presently manufactured in Shijiazhuang, China. These particles have a wood fiber-like appearance as contrasted with commercial grades having a uniform, generally "crystalline" and spherical appearance under magnification. In the manufacture of the polyvinyl alcohol product a single-screw saponifier or hydrolyzer is utilized rather than the prevailing, contemporary belt or tank reactors which are in use in the United States. The screw saponifier draws the polyvinyl alcohol during saponification. As a result, wood fiber-like particles are produced having a relatively low dry bulk density and which swell extensively when fully hydrated. In addition, the particles are superhydrolyzed by allowing the saponification reaction to continue without intervention. Thereafter, the product is shredded and ground as in conventional methods for manufacturing polyvinyl alcohol. The resulting relatively soft, amorphous particles are approximately one-sixteenth to three-eighths of an inch long and approximately one sixty-fourth of an inch in diameter. In addition, the degree of hydrolyzation of the particles is in the range of 99.6 to 99.95 mole percent.

In order to achieve an average particle size which is desirable for practicing the invention, the raw material described above is further processed, preferably in an air-swept impact mill. This mill reduces particle size by striking the material against other particles in the stream. Although other methods may be used, the air-swept mill avoids possible agglomeration of the particles which may result from the heat generated in mechanical grinding, for example.

The particle size of the additive following processing may be varied according to the fiber-based end product which is to be manufactured. In general, the particle size distribution is preferably such that all of the particles will pass a one hundred mesh screen when the additive will be utilized in papermaking applications in order to avoid the formation of transparent spots or "fisheyes" in the formed sheet.

The polyvinyl alcohol wet-end additive described herein, even after reduction in particle size to pass a one hundred mesh screen, substantially retains a fibrillated, branched appearance under magnification. These particles are virtually insoluble at prevailing papermaking temperatures as described above and as demonstrated below in Example I. In addition, the wet-end additive used in accordance with the present method has an extremely high hydrated bulk volume, as that term is described above. For example, and as further described in Example II, below, 10 grams of the additive described herein suspended in a total of 195 grams of water occupied a volume in excess of 10 mls./gm., or specifically 170 milliliters after twenty-four hours, which yields a hydrated bulk volume measurement of approximately 17 mls./gm. On the other hand, the Gohsenol P-250 product described in the literature as suitable for wet-end addition occupied a volume of only 75 milliliters under the same conditions yielding a bulk volume as defined herein of only 7.5 mls./gm. This surprisingly high degree of swelling when fully hydrated is believed to contribute significantly to the ability of the wet-end additive to adhere to pulp or other similar fibers during the initial formation of a sheet at the wet-end of a paper machine, for example. In fact, the wet-end additive, like pulp, can be formed into a handsheet using TAPPI standard methods. Accordingly, the retention of the additive is virtually the same as pulp retention, for example, in actual use.

In use, the wet-end additive as described herein is preferably thoroughly mixed with an aqueous cellulose pulp suspension, for example, prior to the wet-end of the paper machine. This ensures uniform distribution of the polyvinyl alcohol particles in the formed paper or board product. The wet-end additive may be added in dry form prior to the headbox, and at the machine chest for example, but is preferably fully hydrated in an aqueous suspension for approximately thirty minutes at room temperature prior to admixing the polyvinyl alcohol additive in slurry form with the pulp suspension. A suitable representative arrangement for accomplishing the addition in the papermaking or related settings is depicted schematically in FIG. 1. In a related vein, if the addition is made in dry form directly to a fibrous suspension, it is preferably made so as to allow approximately thirty minutes dwell time prior to forming a sheet.

The addition of the polyvinyl alcohol in slurry form can be advantageously accomplished at or prior to the first or second fan pump in paper or board applications as depicted in FIG. 1 and can be metered at a 3–5% slurry, for example, from a supply tank in most applications for admixture with the pulp furnish. In any event, and significantly, the particular wet-end additive employed in accordance with the present invention can withstand the approximately fifteen to thirty minutes dwell time to the wire from the fan pump at prevailing temperatures without dissolving to any appreciable extent (i.e. with losses of less than twenty-five percent). Where the additive is slurried prior to admixing with the pulp furnish, as is preferred, the slurry tank is preferably maintained at room temperature to minimize any incidental loss of the additive into solution.

The addition level of the wet-end additive used in accordance with the present method may be varied over a wide range. In the papermaking or board settings, the level will depend upon the grade of paper or board to be manufactured and prevailing machine operating conditions. Favorable results in the form of enhanced strength properties and improved quality in the product can be achieved in relatively lightweight grades at addition levels as low as 0.25 percent on an oven dried weight basis of pulp. In the manufacture of stiffer grades of paper or board products, the addition level may be significantly higher and up to ten percent or greater to significantly enhance the strength properties or to stiffen these products. In view of the excellent retention properties of the additive, however, the addition levels can be minimized in most applications with attendant economic benefit.

In order to achieve the maximum benefits from the use of the invention, the drying conditions for the formed sheet should be controlled and optimized in each application. In general, the wet-end additive is thought to gelatinize and flow between the pulp fibers during drying so that sufficient moisture must be present in the sheet to ensure unifOrm dispersion and bonding of the additive in situ. At prevailing moisture contents of fifty to seventy percent upon entering the first dryer section, paper temperatures in the range from about 170 degrees Fahrenheit to 240 degrees Fahrenheit are believed to be the optimum. When lighter paper grades such as newsprint are manufactured the first steam-heated drum should preferably be at temperatures of approximately 140–180 degrees Fahrenheit and the balance of the first section at approximately 220–240 degrees Fahrenheit. Subsequent dryer sections may be operated in the range from about 250–270 degrees Fahrenheit to complete the drying of the sheet. It is believed that the process of uniformly incorporating and "fixing" the wet-end additive in the sheet to provide the enhanced products is essentially complete after the moisture content is reduced below about forty percent. Accordingly, it is preferred to maintain overall temperatures in the range from about 220–240 degrees Fahrenheit in the first dryer section to achieve optimum results and avoid over-drying the sheet before the additive completely gels. Of course, optimization of actual operating parmeters will require some routine experimentation on the actual forming machine.

The use of the method for internally strengthening fiber-based products are described herein provides significant increases in the strength properties of the resulting end product. In the paper and board areas these increases are realized through at least improved machine and cross-direction tensile strength, Mullen, and Scott bond measurement. In addition, the "registrability" of paper grades used for printing such as newsprint, is likewise improved through related improvements in the dimensional stability of the paper. Additional operating guidelines and benefits will be described below in connection with representative examples.

EXAMPLE I

In order to determine the effective operating temperatures for use of the wet-end additive in aqueous form at elevated temperatures, the solubility of the additive at various slurry temperatures was determined. Also, the solubility of the Gohsenol P-250 product described in the literature as useful for wet-end addition was likewise determined under the same laboratory conditions.

In order to carry out the experiment, three percent slurries of the additive utilized in accordance with the present invention (hereinafter referred to in the examples under the mark "Fiberol") and the P-250 product were prepared. The respective slurries were prepared using dry product having a particle size which would pass a two hundred mesh screen.

The temperatures of the two slurries were then elevated and maintained for five minutes at elevated temperatures whereupon the percentage of the additives which dissolved was calculated at ten degree increments in the range from 100–130 degrees Fahrenheit. The results are reported below in Table 1. This data discloses that the relative solubility of the P-250 product is comparable at temperatures below about 110 degrees Fahrenheit. Notably, however, the data further discloses that while only fifteen percent of the "Fiberol" wet-end additive used in the present method went into solution, more than seventy-five percent of the P-250 product dissolved. Accordingly, an insignificant fraction of the "Fiberol"additive may be lost into solution at prevailing paper machine operating temperatures while substantial quantities of the P-250 product would simply dissolve in the white water fraction.

TABLE I

| Temperature of 3% Slurry | Percent Dissolved | |
|---|---|---|
| | Fiberol | Gohsenol P-250 |
| 100° F. | 10.3% | 10.6% |
| 110° F. | 11.3% | 12.7% |
| 120° F. | 13.3% | 18.7% |
| 130° F. | 15% | 77.3% |

EXAMPLE II

In a further laboratory experiment, an attempt was made to measure the unique and substantial swelling properties of the "Fiberol" additive when fully hydrated in water. In this connection, the same Gohsenol P-250 product described above in Example I was utilized to provide a comparative measure.

In order to carry out the objectives of this experiment, 10 grams each of the "Fiberol" and P-250 products were weighed into 400 ml. beakers. 160 grams of tap water was then added to each beaker and the mixtures were stirred for approximately one minute. The mixtures were then transferred to two 250 ml. graduated cylinders. Any polyvinyl alcohol remaining in the beakers was transferred into the graduated cylinders using an additional 35 grams of tap water to yield a total of 195 grams of water. The graduated cylinders were gently tapped approximately ten times and then allowed to stand for twenty-four hours.

After a twenty-four hour period, the "Fiberol" additive occupied a volume in the graduated cylinder of 170 ml. while the P-250 product occupied a volume of only 75 ml. under the same conditions. Based on these experiments, the apparent or hydrated bulk volumes of the respective additives at a 200 mesh particle size, expressed in milliliters per gram, was greater than 10 ml./gm. for the Fiberol additive as compared to 7.5 ml./gm. of the P-250 additive described in the literature. The high degree of "swellability" of the preferred additive is unique in comparison to other polyvinyl alcohol products and contributes to the excellent retention properties of the additive in use.

EXAMPLE III

In order to obtain representative measures of the relative improvement in the strength properties of paper products made in accordance with the method described herein, an experimental trial was conducted on a pilot fourdrinier paper machine. Thirty pound newsprint furnish was utilized in the trial to produce paper for physical testing. The wet-end additive was processed in an airswept mill as described above in the text and was admixed with the furnish at varying levels of addition.

Eight drying cylinders were used in the pilot scale trial with the representative temperatures of the paper and the moisture contents of the sheet at each cylinder as follows:

| Dryer Number | Sheet Temperature (°F.) | Moisture Content (%) | Time (Seconds) |
|---|---|---|---|
| 1 | 108 | 61 | 3 |
| 2 | 184 | 56 | 6 |
| 3 | 188 | 49 | 9 |
| 4 | 174 | 42 | 12 |
| 5 | 185 | 33 | 15 |
| 6 | 168 | 17 | 18 |
| 7 | 172 | 9 | 21 |
| 8 | 192 | 7 | 24 |

Figure 2:
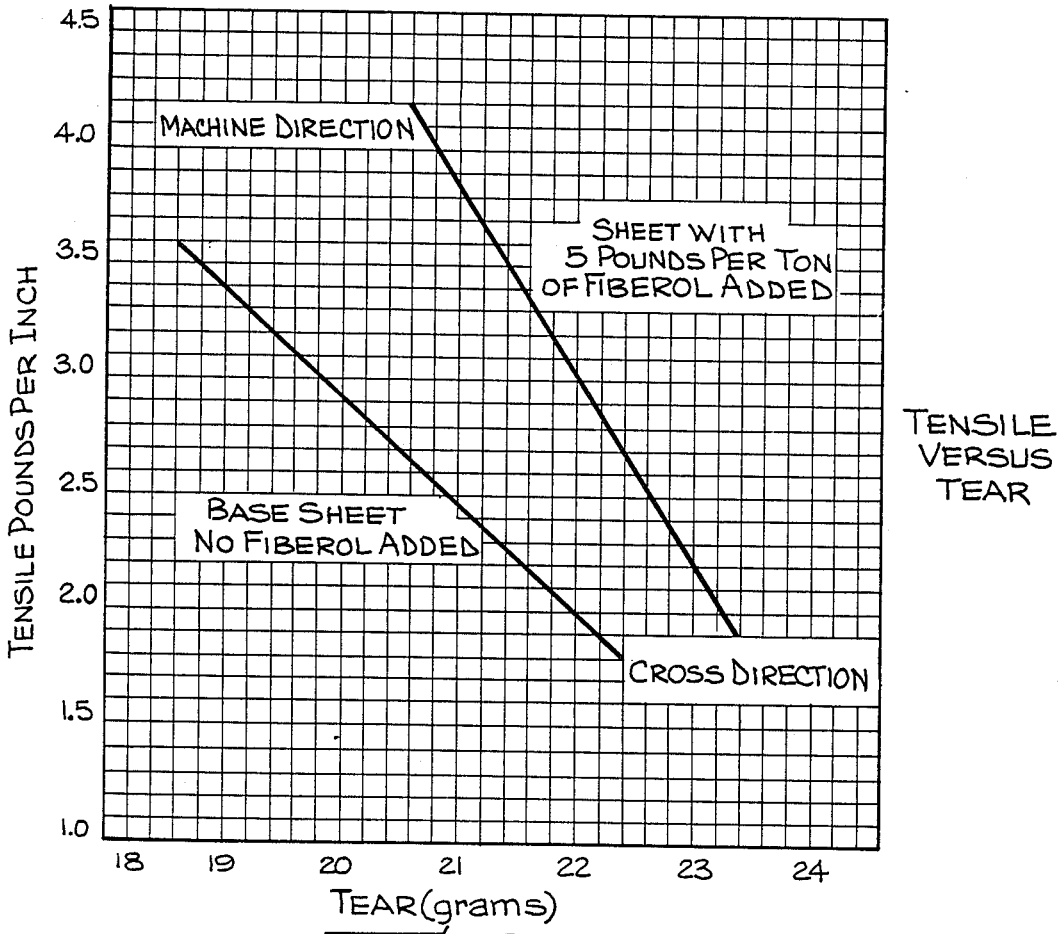
FIG. 2 is a graphic depiction of tensile strength versus tear with and without the use of the wet-end additive based on the physical testing data described in Example III, below.
Figure 3:
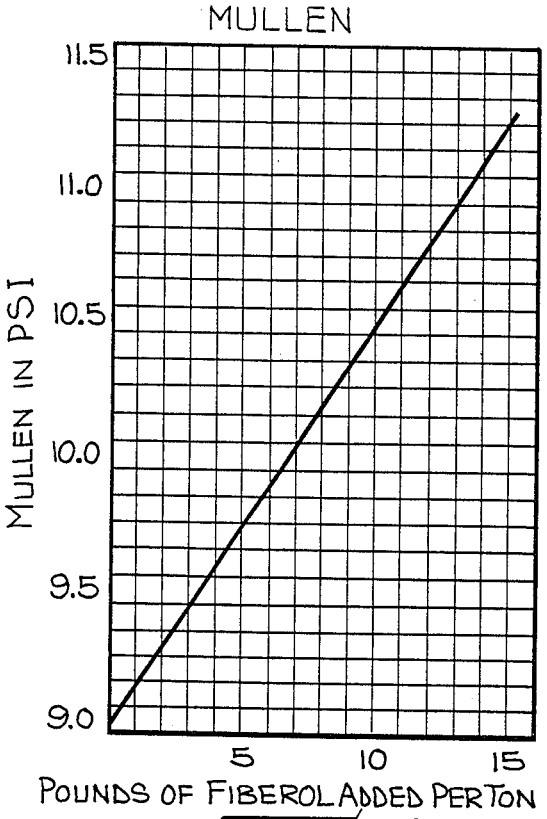
FIG. 3 is a graphic depiction of data reflecting increases in Mullen strength through the use of the invention in connection with a 30 pound newsprint product as described in Example III below.
Figure 4:
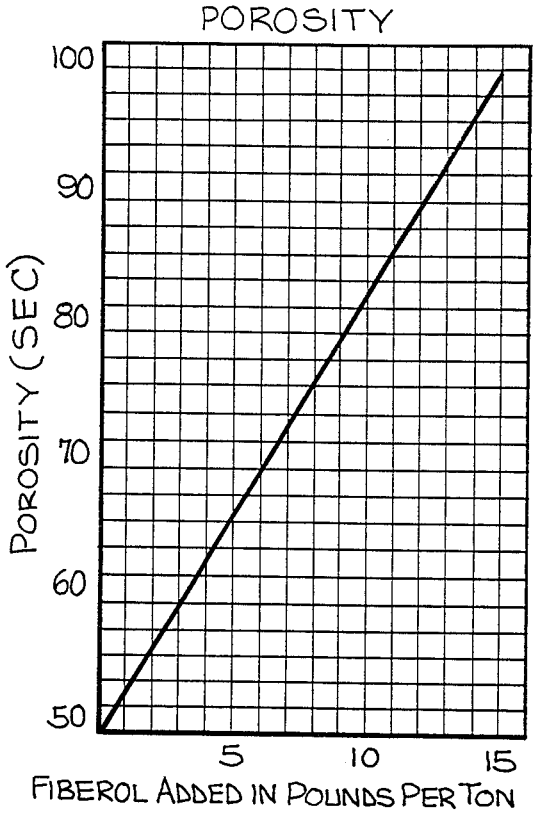
FIG. 4 is a graphic depiction of data reflecting improvements in the porosity of the product through the use of the invention in connection with a 30 pound newsprint product as described in Example III, below.

The results of physical testing on the 30 pound newsprint at varying levels of addition of the "Fiberol" wet-end additive are reproduced below in Table III. As can be seen by reference to the data, the use of the present method provided significant improvements in the strength properties of the resulting newsprint product. A graph of the tensile strength versus tear of the newsprint with the "Fiberol" additive at a five percent addition level and without any addition is shown in FIG. 2. The increase in Mullen based on the data is likewise plotted in FIG. 3 while the relative improvement in the porosity of the 30 pound newsprint product is depicted in FIG. 4.

TABLE III

| Addition Level lbs./ton | Tensile (Machine Direction) | Scott Bond | Porosity | Basis Weight |
|---|---|---|---|---|
| 0 | 2.85 | 7.3 | 49.4 | 29.9 |
| 10 | 3.69 | 85.4 | 82.8 | 30.7 |
| 10 | 3.65 | 93.0 | 86.9 | 30.4 |
| 10 | 4.0 | 84.0 | 82.5 | 30.7 |
| 5 | 3.99 | 81.2 | 77.1 | 31.0 |
| 5 | 4.2 | 84.4 | 78.9 | 30.8 |
| 5 | 4.2 | — | 78.9 | 30.9 |
| 5 | 4.11 | — | 81.4 | 30.9 |
| 15 | 4.10 | 83.6 | 84.0 | 30.0 |
| 15 | 4.06 | 91.8 | 92.9 | 29.5 |
| 15 | 3.93 | 92.8 | 97.5 | 29.8 |

EXAMPLE IV

Figure 5:
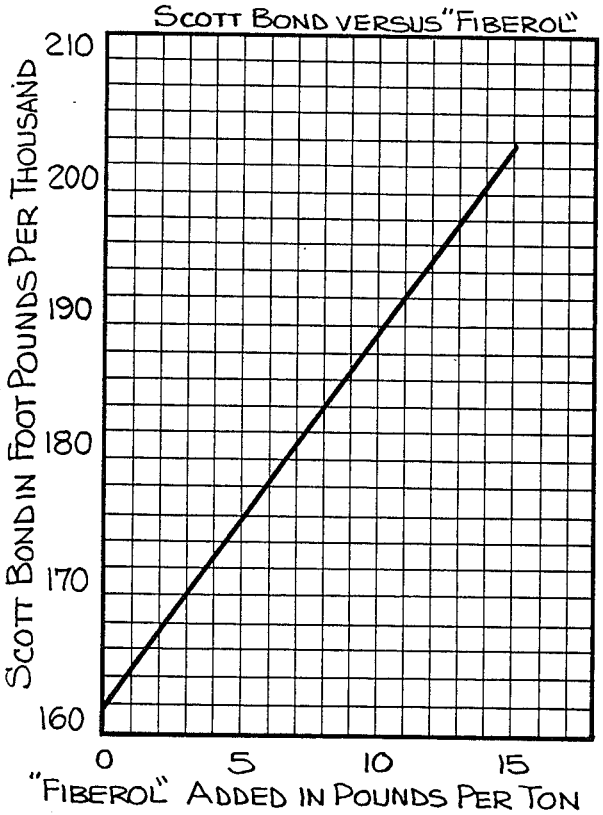
FIG. 5 is a graphic depiction of data reflecting improvements in Scott Bond of a board product as described in Example IV, below.
Figure 6:
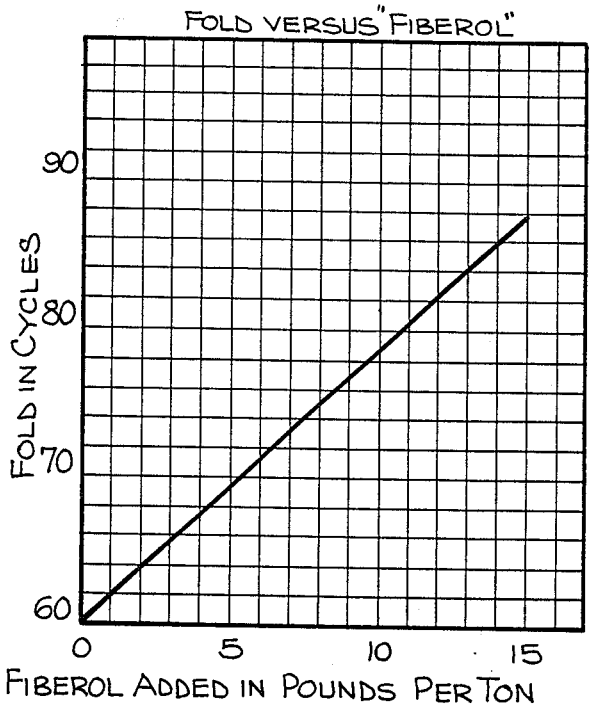
FIG. 6 is a graphic depiction of data reflecting improvements in the fold strength of a board product as described in Example IV, below.
Figure 7:
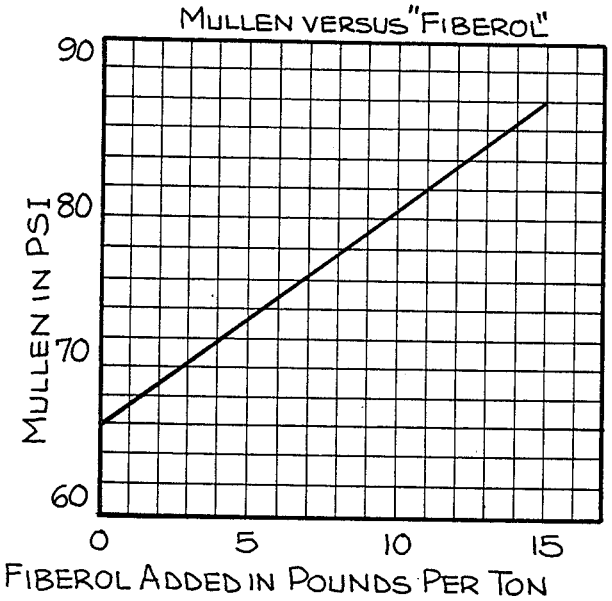
FIG. 7 is a graphic depiction of data reflecting improvements in strength as measured by Mullen of a board product as described in Example IV, below.

The effectiveness of the wet-end additive for use in improving the strength properties of board products was also demonstrated on a pilot fourdrinier machine. The data generated from physical testing of the resulting 30 lb. per 1,000 sq. ft. of product is reproduced below in Table IV and depicted in graphic form as extrapolated in FIG. 5 (Scott Brand), FIG. 6 (Fold strength), and FIG. 7 (Mullen) to demonstrate the relative improvement in these important properties at varying levels of addition of the wet-end additive described herein.

TABLE IV

| Addition Level lbs./ton | Basis Weight (lbs. per 3,000 sq. ft.) | Fold Strength | Mullen (two measurement) | Scott | Canadian Std. Freeness |
|---|---|---|---|---|---|
| 5 | 90.5 | 69 | 73.7/72.0 | 179 | 360 |
| 5 | 87.9 | 76 | 80.5/77.0 | 188 | 360 |
| 10 | 96.5 | 85 | 84.0/84.5 | 203 | 360 |
| 10 | 94.5 | 75 | 83.5/81.0 | 206 | 360 |
| 15 | 90.9 | 74 | 78.0/82.7 | 206 | 360 |
| 15 | 92.9 | 93 | 81.0/87.0 | 203 | 360 |
| 20 | 89.5 | 98 | 84.0/87.3 | 207 | 360 |
| 20 | 89.3 | 79 | 82.0/81.0 | 215 | 360 |

EXAMPLE V

The effectiveness of the present method in improving the strength and related properties of a formed paper product under actual mill conditions was proven in an experimental mill trial. This trial was performed on a paper machine used for manufacturing newsprint. The machine was a twin wire fourdrinier machine capable of maximum operating speeds of 2700 feet per minute with a twenty foot trim.

The wet-end additive utilized in the experimental trial was processed as described in text and made up in a slurry tank. It was mixed for approximately thirty minutes in water at a concentration level of approximately five percent by weight in the suspension. The furnish for the trial was conventional recycled newsprint with thick stock constituents of approximately eight percent clay, two percent ink, seventy five percent mechanical pulp, and fourteen percent chemical pulp.

The additive was metered from the make-up slurry tank and introduced at the second fan pump at initial levels of approximately 3.3 pounds per ton and up to approximately seven pounds per ton or approximately 0.35 percent on an oven-dried weight basis for the pulp. In accordance with ordinary operating parameters, the machine chest was maintained at an approximately four percent consistency and 125 degrees Fahrenheit.

Following the initial "equilibrium" phase, where the additive was introduced at approximately 3.3 pounds per ton, the addition level was increased and the temperature in the first dryer section was raised approximately 10–20 degrees Fahrenheit from normal operating parameters so that the first three dryer drums were operating at temperatures of approximately 180–190 degrees Fahrenheit while the remaining approximately twelve drums in the first section were operated at temperatures in the range of about 240–260 degrees Fahrenheit.

The available results of physical testing on the paper manufactured during the trial are reproduced below in Table V.

TABLE V

| Addition Level lbs./ton | Tensile Strength M.D. | Tensile Strength X.D. | Scott Bond | Basis Weight |
|---|---|---|---|---|
| 0 | 20 | 15 | 36.0 | 30.0 |
| 3.3 | 25.37 | 14.57 | 34.4 | 29.9 |
| 3.3 | 33.21 | 14.56 | 31.4 | — |
| 6.0 | 31.1 | 16.80 | 39.0 | 30.0 |
| 7.0* | 38.3 | 16.4 | 39.6 | — |
| 7.0 | 40.2 | 17.1 | 41.5 | 29.6 |
| 7.0 | 37.6 | 18.0 | 41.8 | 30.1 |

*Pressure, and in turn, temperature, in the first dryer section was increased as described in text.

As can be seen by reference to the data reproduced in Table V, above, the use of the method described herein provided significant increases in the strength properties of the sheet under ordinary mill conditions and especially significant improvements were achieved in the machine direction tensile strength which is critical to resisting paper breaks during the printing operation. In addition, the noted improvement in Scott Bond is also significant and which indicates an improvement in the formed sheet's resistance to "picking" during printing.

EXAMPLE VI

A second experimental trial on the same paper machine described above in Example V was conducted. Unfortunately, the machine was in need of cleaning which affected the "scatter" of the data. In any event, the operating speed of the machine was increased significantly during portions of the trial, and as a result of the use of the wet-end additive, up to approximately 2,780 feet per minute while the overall benefits through improvements in product strength were significant. The results of the physical testing which could be performed are reported below in Table VI.

TABLE VI

| Addition Level lbs./ton | Tensile Strength M.D. | Tensile Strength X.D. | Scott Bond | Machine Speed |
|---|---|---|---|---|
| 0 | 30.02 | 16.93 | 32.8 | 2685 |
| 5 | 36.64 | 17.85 | 38.6 | 2688 |
| 5 | 38.80 | 18.37 | 33.6 | 2680 |
| 10 | 40.53 | 19.62 | 35.6 | 2685 |
| 10 | 36.84 | 15.19 | 34.6 | 2680 |
| 10 | 38.19 | 18.78 | 36.4 | 2750 |
| 10 | 39.38 | 18.62 | 36.2 | 2770 |
| 10–15(approx) | 43.45 | 19.62 | 41.4 | 2780 |

As can additionally be seen by reference to the data set forth in Table VI, above, the use of the method of internally strengthening paper as described herein again provided notable increases in machine and cross-direction tensile strength and Scott Bond. It should be additionally noted that paper from the experimental trial was supplied to a printer for feedback on its operability. The printer reported increases in printing speeds at a surprising sixty-five percent above normal. In addition, the runnability of the paper as measured by the quality of registration was reported to be "superior."

While the magnitude of the benefits which can be achieved through the use of the invention would be expected to vary with the particular product to be strengthened and the operating parameters of the machine on which it is manufactured, it is clear that the use of the present invention can provide significant surprising improvements in the strength properties of products manufactured from fibrous materials and especially in paper nd board products.

In the drawings and specification, there has been set forth preferred embodiments of the invention, and although specific terms are employed, they are used in a generic and descriptive sense only and not for purposes of limitation.

That which is claimed is:

1. A process for internally strengthening a fiber based product, including paper or board products, wherein water is drained from an aqueous suspension of pulp or other fibers and a wet-end additive to form a web and the web is thereafter dried, the improvement which comprises using as a wet-end additive highly swellable, super hydrolyzed polyvinyl alcohol particles which are at least 99.6 mole percent hydrolyzed; said polyvinyl alcohol particles having a fibrillated, branched appearance under magnification, being substantially insoluble in water at 130 degrees Fahrenheit, and said particles additionally being of a size which will pass a one hundred mesh screen or finer in the unswollen state and having a hydrated bulk volume in excess of about ten milliliters per gram.

2. A process according to claim 1 wherein the highly swellable polyvinyl alcohol particles form a stable suspension in water.

3. A process according to claim 1 wherein no more than about 25 percent by weight of the polyvinyl alcohol particles will dissolve in water at 130 degrees Fahrenheit.

4. A process according to claim 1 wherein the wet-end additive is slurried prior to admixture with the aqueous suspension and wherein the addition level of the additive is in the range from about 0.25 percent to 3 percent by weight based on the oven-dried weight of the fiber in suspension.

5. A process according to claim 1 wherein the super hydrolyzed polyvinyl alcohol particles are fully hydrated in an aqueous suspension by admixing with water for at least thirty minutes prior to admixing with the fiber.

6. A process according to claim 5 wherein no more than 25 percent by weight of the polyvinyl alcohol particles will dissolve in an aqueous suspension at 130 degrees Fahrenheit.

7. A process according to claim 6 wherein the web containing the additive is dried by passing the web into contact with a plurality of steam heated cylinder dryers.

8. A process according to claim 7 wherein the temperature of the cylinder dryers is maintained in the range from about 170 to 240 degrees Fahrenheit.

9. A fiber-based sheet material produced by the process as defined in claim 1.

10. A process for internally strengthening a paper product which comprises forming a web from an aqueous suspension of pulp and a wet end additive, said additive comprising highly swellable, super hydrolyzed polyvinyl alcohol particles which are at least 99.6 mole percent hydrolyzed, which have a fibrillated, branched structure, and which are substantially insoluble in water at 130 degrees Fahrenheit; said particles also being of a size which will pass a one hundred mesh screen or finer in the unswollen state with a hydrated bulk volume in excess of about ten milliliters per gram, and thereafter pressing the web to reduce its moisture content to less than about 60 percent, directing the web into and through a dryer, and drying the web containing said additive at dryer temperatures from about 170 to 240 degrees Fahrenheit.

11. A process according to claim 10 wherein the web is dried by passing the web through a plurality of steam heated cylinder dryers and wherein the temperature of the first three dryer drums are maintained in the range from about 140 to 240 degrees Fahrenheit.

12. A fiber-based sheet material produced by the process as defined in claim 10.

13. A process for internally strengthening paper or board products during a papermaking process in which a sheet is formed by draining an aqueous suspension comprising an admixture of pulp fibers and a wet-end additive through apertures in a continuously moving wire, and which is characterized by the enhanced strength possessed by the resulting sheet, and comprising the steps of admixing an aqueous suspension of cellulose fibers with an aqueous suspension of fully swollen super hydrolyzed polyvinyl alcohol particles which are at least 99.6 mole percent hydrolyzed prior to depositing the suspension on the moving wire; said polyvinyl alcohol particles having a fibrillated, branched appearance under magnification, being substantially insoluble in water at 130 degrees Fahrenheit, and said particles additionally having a hydrated bulk volume in excess of about ten milliliters per gram and being of a size which will pass a one hundred mesh screen or finer in the unswollen state; depositing the admixed aqueous suspension of fiber and wet-end additive on a continuous moving wire so as to form a sheet of intermingled cellulose fibers having swollen polyvinyl alcohol particles interspersed therein and drying the formed sheet in the presence of moisture to form a paper product having enhanced strength properties.

14. A process according to claim 13 wherein the temperature of the aqueous suspension containing the fiber and the wet-end additive is maintained at a temperature in excess of about 125 degrees Fahrenheit.

15. A process according to claim 14 wherein the wet-end additive is maintained in suspension for at least thirty minutes prior to admixture with the suspension containing the pulp fibers.

16. A process according to claim 15 wherein the wet-end additive is admixed with the aqueous suspension containing pulp fibers at levels sufficient to provide an additional level in the range from about 0.25 to 3 percent based on the oven-dried weight of the fiber.

17. A fiber-based sheet material produced by the process as defined in claim 13.

* * * * *